US007464910B1

(12) United States Patent
St. Germain et al.

(10) Patent No.: US 7,464,910 B1
(45) Date of Patent: Dec. 16, 2008

(54) GUITAR HANGER APPARATUS

(76) Inventors: John M. St. Germain, 16290 SW. 100th Ave., Tigard, OR (US) 97224; Linda A. St. Germain, 16290 SW. 100th Ave., Tigard, OR (US) 97224

( * ) Notice: Subject to any disclaimer, the term of this patent is extended or adjusted under 35 U.S.C. 154(b) by 3 days.

(21) Appl. No.: 11/761,308

(22) Filed: Jun. 11, 2007

(51) Int. Cl.
*A47F 5/00* (2006.01)

(52) U.S. Cl. ..... 248/301; 248/305; 248/340; 84/327; 211/85.6

(58) Field of Classification Search ..... 248/301, 248/304, 305, 306, 339, 340; 211/85.6, 60.1, 211/66; 84/327; D6/317, 327; D8/373
See application file for complete search history.

(56) References Cited

U.S. PATENT DOCUMENTS 1,389,218 A * 8/1921 Primeau ..... 211/104
1,480,829 A * 1/1924 Moran ..... 211/32
D308,782 S * 6/1990 Getsi ..... D6/567
5,224,607 A * 7/1993 Koresko ..... 211/34
5,911,396 A 6/1999 Bireley
2007/0039446 A1 * 2/2007 Samu ..... 84/327

* cited by examiner

*Primary Examiner*—Korie Chan
(74) *Attorney, Agent, or Firm*—Crossley Patent Law; Mark A. Crossley

(57) ABSTRACT

The guitar hanger apparatus is for use in hanging a guitar or like stringed instrument from a clothes rod such that the instrument hangs vertically below the rod. The hook for hooking the apparatus on the rod curves downwardly into a transition. The transition flows into the reverse curl. The reverse curl extends below and a distance beyond the hook back side. The horizontal is connected to a bottom of the reverse curl. The vertical affixed to the horizontal is thereby positions the padded v-member, which supports the neck and headstock of the instrument, below the hook and hence the rod.

18 Claims, 4 Drawing Sheets

GUITAR HANGER APPARATUS

TO ALL WHOM IT MAY CONCERN

Be it known that we, John M. and Linda A. St. Germain, citizens of the United States, have invented new and useful improvements in a guitar hanger apparatus as described in this specification.

BACKGROUND OF THE INVENTION

Guitar storage has long been a problem. Space and security against damage are typical of the many concerns faced when storing a stringed instrument such as a guitar. Guitar stands are available but are not conducive to space saving, and typically place the instrument on ground level, where damage is even more likely to occur. Other devices have been offered which are either hooked within a frame of some sort, or require semi-permanent fastening to a surface. Many stringed instrument supporting devices are far more complex than is desirable. Such devices are therefore more expensive to produce and sell. Many guitars are stored in closets, and such storage typically involves a case to insure against damage, as closet floor space is typically used due to the large amount of shelf space required to store such an instrument.

What is needed is a basic guitar storage apparatus which can suspend a stringed instrument, such as a guitar, from a typical clothes hanger rod or the like. The apparatus provided herein provides such, with an inherent counterbalancing feature to provided upright hanging of the instrument below the rod.

FIELD OF THE INVENTION

The guitar hanger apparatus relates to devices for supporting a guitar and more especially to a guitar hanger apparatus which can be hung from a typical clothes rod or the like.

SUMMARY OF THE INVENTION

The general purpose of the guitar hanger apparatus, described subsequently in greater detail, is to provide a guitar hanger apparatus which has many novel features that result in an improved guitar hanger apparatus which is not anticipated, rendered obvious, suggested, or even implied by prior art, either alone or in combination thereof.

To attain this, the guitar hanger apparatus is basic and is selectively made of a variety of materials. Metal is one example of such material. The ideal size is about 18 inches tall and about 5 inches deep. The apparatus is ideally seamlessly constructed, with regard to the hook, the curve, the transition, the reverse curl, the horizontal, and the vertical, but may be pieced together in manufacture, as needed, for efficiency and low cost. The apparatus may be made substantially of tubular material stock, or of rectangular material stock. The sweeping curves of the apparatus, and the length of each component—the curve, the transition, the reverse curl, the horizontal, and the vertical—provide for an instrument to hang directly below the apparatus and a clothes rod or the like, which the apparatus is hung on. Guitars and other similar stringed instruments can thereby be supported correctly, without damage to the instrument, and can be off of a floor or other surface. Space savings and instrument safety are thereby provided by the apparatus.

Thus has been broadly outlined the more important features of the improved guitar hanger apparatus so that the detailed description thereof that follows may be better understood and in order that the present contribution to the art may be better appreciated.

An object of the guitar hanger apparatus is to be formed of a basic design.

Another object of the guitar hanger apparatus is to be inexpensively produced and sold.

A further object of the guitar hanger apparatus is to provide cushioned support of the instrument's headstock.

And, an object of the guitar hanger apparatus is to provide for hanging the instrument on a clothes rod or the like.

An added object of the guitar hanger apparatus is to provide for the instrument to hang vertically below the rod.

These together with additional objects, features and advantages of the improved guitar hanger apparatus will be readily apparent to those of ordinary skill in the art upon reading the following detailed description of presently preferred, but nonetheless illustrative, embodiments of the improved guitar hanger apparatus when taken in conjunction with the accompanying drawings.

In this respect, before explaining the current embodiments of the improved guitar hanger apparatus in detail, it is to be understood that the guitar hanger apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved guitar hanger apparatus. It is therefore important that the claims be regarded as including such equivalent constructions insofar as they do not depart from the spirit and scope of the guitar hanger apparatus. It is also to be understood that the phraseology and terminology employed herein are for purposes of description and should not be regarded as limiting.

DETAILED DESCRIPTION OF THE DRAWINGS

Figure 1:
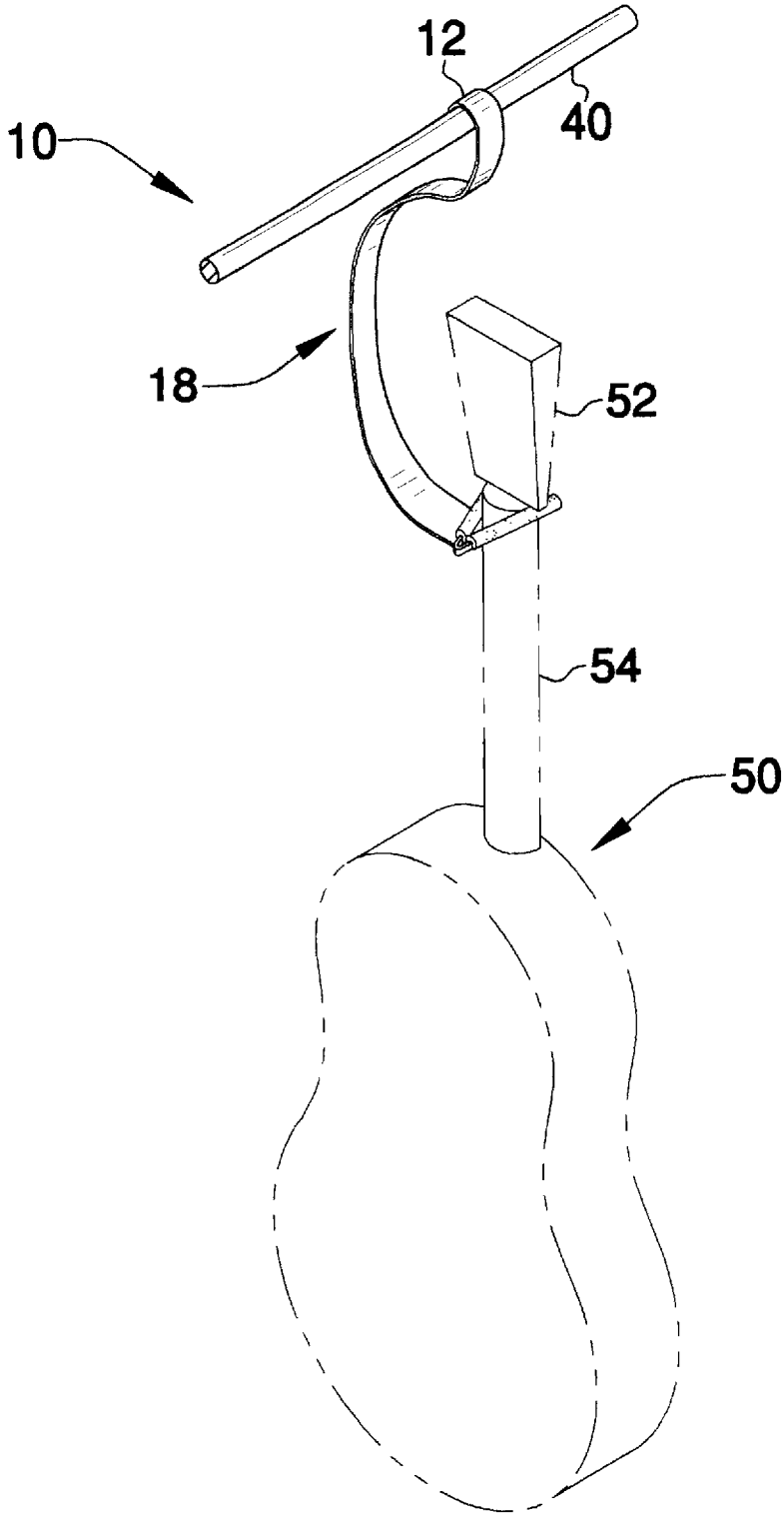
FIG. 1 is a perspective view of the apparatus in use.
Figure 2:
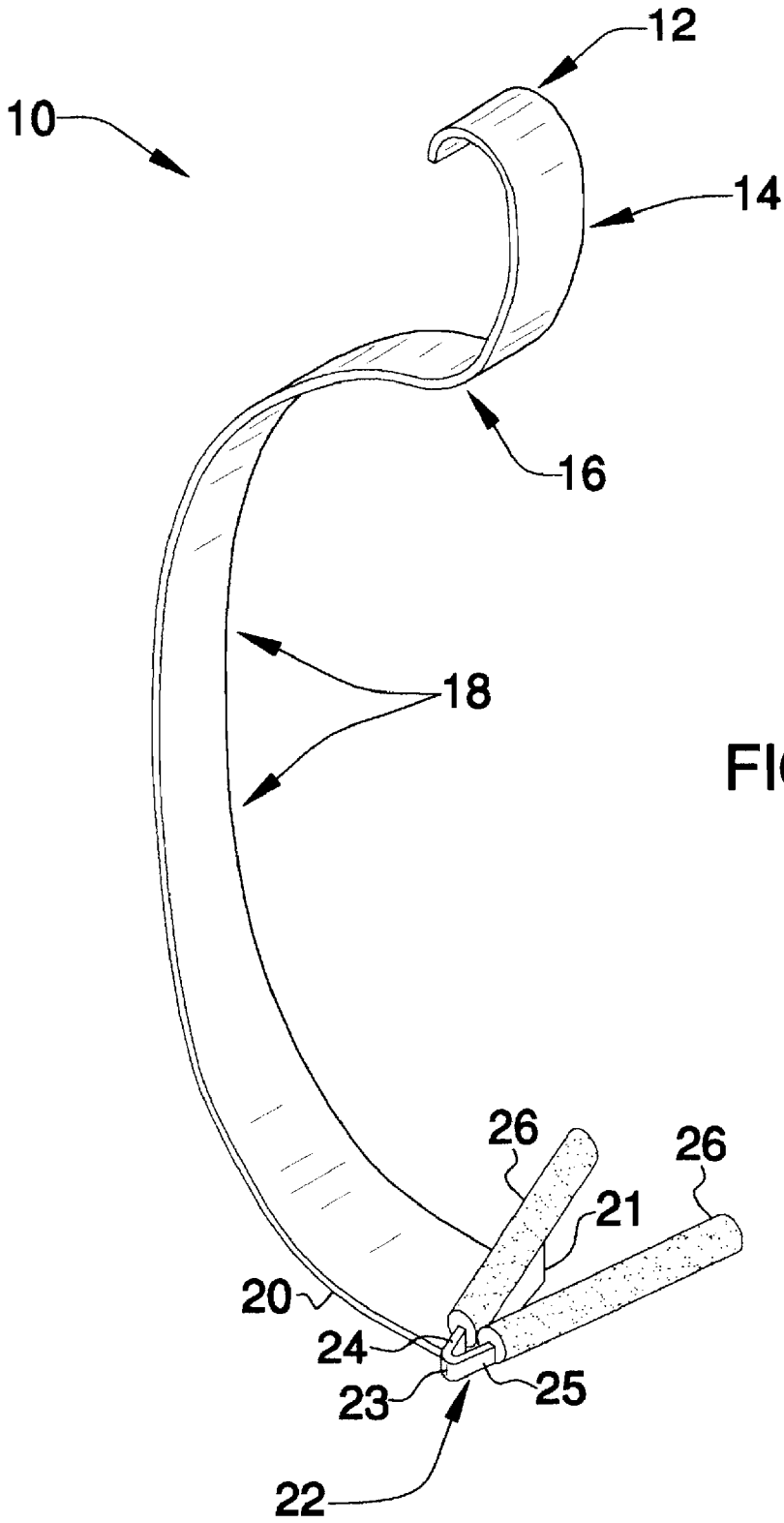
FIG. 2 is a perspective view.
Figure 3:
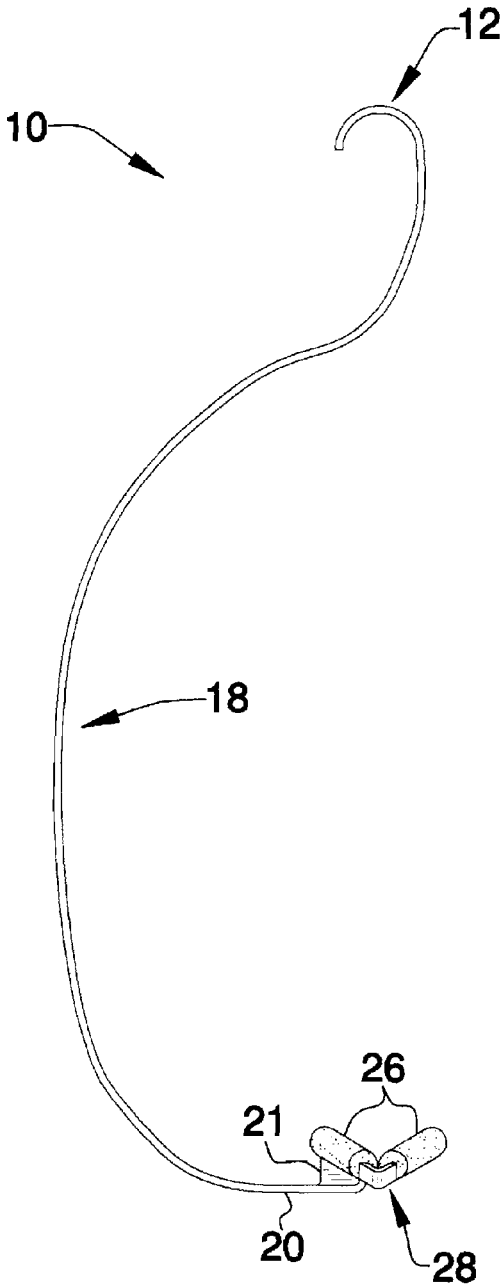
FIG. 3 is a lateral elevation view.
Figure 4:
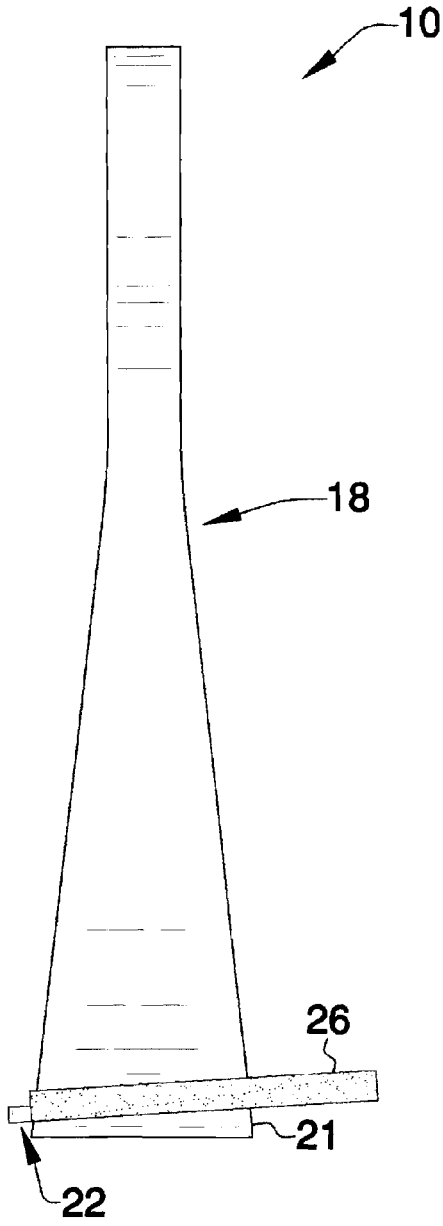
FIG. 4 is a front elevation view.
Figure 5:
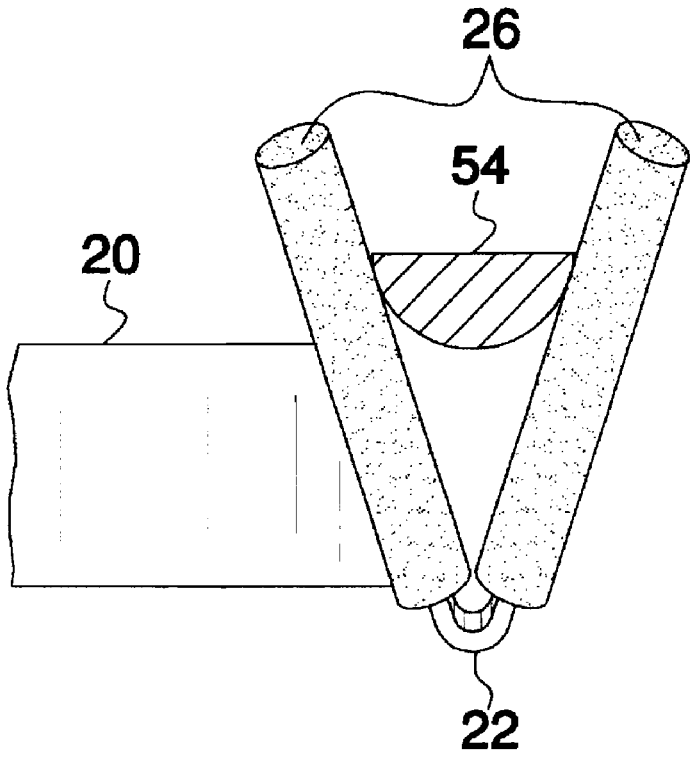
FIG. 5 is a top plan view of the horizontal and v-member with pads, with guitar neck cross section between the pads.

With reference now to the drawings, and in particular FIGS. 1 through 5 thereof, the principles and concepts of the guitar hanger apparatus generally designated by the reference number 10 will be described.

Referring to FIGS. 1-5, the guitar hanger apparatus 10 is for use in hanging a guitar 50 or other such stringed instrument from a clothes rod 60 such that the guitar 50 hangs vertically below the rod 60. The apparatus 10 comprises a hook 12 for hooking on the rod 60. The hook 12 has a front side and an open back side. The open back side provides for hooking the apparatus 10 over the rod 60 or other similar object. The curve 14 is seamlessly extended downwardly from the hook 12 front side. The transition 16 seamlessly connects the curve 14 to a reverse curl 18. The reverse curl 18 is extended below and a distance beyond the hook 12 back side. The horizontal 20 is seamlessly connected to the bottom of the reverse curl 18. In apparatus 10 use, the vertical 21 is thusly positioned below the hook 12. The v-member 22 has a first leg 24 and a second leg 25. The v-member 22 is further comprised of a first end and a second end, and a top side and a bottom side. The first leg 24 is connected to the second leg 25 at a bend 23 of the first end of the v-member 22. The bottom of the first leg 24 is, in one embodiment of the apparatus 10 (not shown) connected directly to the horizontal 20. The illustrated embodiment of the apparatus 10 provides that the bottom of the first leg 24 of the v-member 22 is connected to the vertical 21. The vertical 21 is from thence connected to the horizontal 20. The v-member 22 first end is positioned horizontally below the v-member 22 second end. This slight angle from horizontal helps retain a guitar 50 in position on the apparatus 10. A semicircular pad 26 is affixed to each of the first leg 24 and the second leg 26 of the v-member 22. The pads 26 are each provided with a pad slot 28 to allow each pad 26 to fit the v-member 22. The pads 26 are provided for contact with a headstock 52 and neck 54 of the guitar 50.

With respect to the above description then, it is to be realized that the optimum dimensional relationships for the parts of the guitar hanger apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the guitar hanger apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the guitar hanger apparatus may be used.

Therefore, the foregoing is considered as illustrative only of the principles of the guitar hanger apparatus. Further, since numerous modifications and changes will readily occur to those skilled in the art, it is not desired to limit the guitar hanger apparatus to the exact construction and operation shown and described, and accordingly, all suitable modifications and equivalents may be resorted to, falling within the scope of the guitar hanger apparatus.

What is claimed is:

1. A guitar hanger apparatus for use in hanging a guitar from a clothes rod such that the guitar hangs vertically below the rod, the apparatus comprising:

a hook for hooking on the rod, the hook having a front side and an open back side;

a curve extended downwardly from the hook front side;

a transition connecting the curve to a reverse curl, the reverse curl extended below and a distance beyond the hook back side;

a horizontal connected to a bottom of the reverse curl;

a v-member having a first leg and a second leg, a first end and a second end, a top side and a bottom side, the first leg connected to the second leg at a bend of the first end of the v-member, the bottom side of the first leg connected to the horizontal;

a semicircular pad affixed to each leg of the v-member, the pads for contact with a headstock and neck of the guitar.

2. The apparatus according to claim 1 wherein the v-member first end is positioned horizontally below the v-member second end.

3. The apparatus according to claim 1 wherein the hook, the curve, the transition, and the horizontal are further comprised of tubular material.

4. The apparatus according to claim 2 wherein the hook, the curve, the transition, and the horizontal are further comprised of tubular material.

5. The apparatus according to claim 1 wherein the hook, the curve, the transition, and the horizontal are further comprised of rectangular material.

6. The apparatus according to claim 2 wherein the hook, the curve, the transition, and the horizontal are further comprised of rectangular material.

7. A guitar hanger apparatus for use in hanging a guitar from a clothes rod such that the guitar hangs vertically below the rod, the apparatus comprising:

a hook for hooking on the rod, the hook having a front side and an open back side;

a curve extended downwardly from the hook front side;

a transition connecting the curve to a reverse curl, the reverse curl extended below and a distance beyond the hook back side;

a horizontal connected to a bottom of the reverse curl;

a vertical connected to an end of the horizontal, whereby the vertical is positioned below the hook;

a v-member having a first leg and a second leg, a first end and a second end, a top side and a bottom side, the first leg connected to the second leg at a bend of the first end of the v-member, the bottom side of the first leg connected to the vertical;

a semicircular pad affixed to each leg of the v-member, the pads for contact with a headstock and neck of the guitar.

8. The apparatus according to claim 7 wherein the v-member first end is positioned horizontally below the v-member second end.

9. The apparatus according to claim 7 wherein the hook, the curve, the transition, the horizontal, and the vertical are further comprised of tubular material.

10. The apparatus according to claim 8 wherein the hook, the curve, the transition, the horizontal, and the vertical are further comprised of tubular material.

11. The apparatus according to claim 7 wherein the hook, the curve, the transition, the horizontal, and the vertical are further comprised of rectangular material.

12. The apparatus according to claim 8 wherein the hook, the curve, the transition, the horizontal, and the vertical are further comprised of rectangular material.

13. A guitar hanger apparatus for use in hanging a guitar from a clothes rod such that the guitar hangs vertically below the rod, the apparatus comprising:

a hook for hooking on the rod, the hook having a front side and an open back side;

a curve seamlessly extended downwardly from the hook front side;

a transition seamlessly connecting the curve to a reverse curl, the reverse curl extended below and a distance beyond the hook back side;

a horizontal seamlessly connected to a bottom of the reverse curl;

a vertical connected to an end of the horizontal, whereby the vertical is positioned below the hook;

a v-member having a first leg and a second leg, a first end and a second end, a top side and a bottom side, the first leg connected to the second leg at a bend of the first end of the v-member, the first leg connected to the vertical;

a semicircular pad affixed to each leg of the v-member, the pads for contact with a headstock and neck of the guitar.

14. The apparatus according to claim 13 wherein the v-member first end is positioned horizontally below the v-member second end.

15. The apparatus according to claim 13 wherein the hook, the curve, the transition, the horizontal, and the vertical are further comprised of tubular material.

16. The apparatus according to claim 14 wherein the hook, the curve, the transition, the horizontal, and the vertical are further comprised of tubular material.

17. The apparatus according to claim 13 wherein the hook, the curve, the transition, the horizontal, and the vertical are further comprised of rectangular material.

18. The apparatus according to claim 14 wherein the hook, the curve, the transition, the horizontal, and the vertical are further comprised of rectangular material.

* * * * *